US011413496B2

(12) United States Patent
Wang

(10) Patent No.: US 11,413,496 B2
(45) Date of Patent: Aug. 16, 2022

(54) ANGLE ADJUSTING MECHANISM AND FITNESS BIKE INSTALLED WITH THE ANGLE ADJUSTING MECHANISM

(71) Applicant: ZHANGZHOU KANG SHEN SPORTS PRODUCTS CO., LTD., Fujian (CN)

(72) Inventor: Qiaowen Wang, Fujian (CN)

(73) Assignee: ZHANGZHOU KANG SHEN SPORTS PRODUCTS CO., LTD., Fujian (CN)

( * ) Notice: Subject to any disclaimer, the term of this patent is extended or adjusted under 35 U.S.C. 154(b) by 147 days.

(21) Appl. No.: 16/935,202

(22) Filed: Jul. 22, 2020

(65) Prior Publication Data

US 2021/0387052 A1 Dec. 16, 2021

(30) Foreign Application Priority Data

Jun. 10, 2020 (CN) ..... 202021054705.9

(51) Int. Cl.
*A63B 22/06* (2006.01)
*A63B 22/00* (2006.01)

(52) U.S. Cl.
CPC ..... *A63B 22/0605* (2013.01); *A63B 22/0046* (2013.01); *A63B 2022/0611* (2013.01); *A63B 2022/0635* (2013.01)

(58) Field of Classification Search
CPC ..... A63B 22/0605; A63B 22/0087; A63B 22/0046; A63B 2022/0611; A63B 2022/0635; A63B 22/0012; A63B 23/03575; A63B 21/4035; A63B 2210/50
See application file for complete search history.

(56) References Cited

U.S. PATENT DOCUMENTS 6,387,024 B1 * 5/2002 Monti ..... A63B 23/03525 482/130
10,052,516 B1 * 8/2018 Lin ..... A63B 23/1209
D899,534 S * 10/2020 Chuang ..... D21/667
2006/0217249 A1 * 9/2006 Webber ..... A63B 23/02 482/142
2015/0335936 A1 * 11/2015 Shakespeare ..... A63B 22/0605 482/58

(Continued)

*Primary Examiner* — Andrew S Lo
*Assistant Examiner* — Andrew M Kobylarz
(74) *Attorney, Agent, or Firm* — JCIP Global Inc.

(57) ABSTRACT

An angle adjusting mechanism includes a first bracket and a second bracket hinged to each other. The second bracket is provided with two arc-shaped position-limiting slots, and a set of position-limiting holes is arranged in the position-limiting slots. A diameter of the position-limiting holes is larger than a slot diameter of the position-limiting slot. A bolt passes through the first bracket and the position-limiting slots and is movable along the first bracket and the position-limiting slots. An end portion of the bolt is provided with an adjusting segment and a position-limiting segment. A diameter of the adjusting segment is smaller than a diameter of the position-limiting segment. The adjusting segment and the position-limiting slot are engaged to adjust an angle of the second bracket relative to the first bracket. The position-limiting segment and the position-limiting holes are engaged to fix the first bracket and the second bracket after adjustment.

12 Claims, 9 Drawing Sheets

(56) References Cited

U.S. PATENT DOCUMENTS

| | | | | |
|---|---|---|---|---|
| 2017/0043202 | A1* | 2/2017 | Chuang | A63B 22/0015 |
| 2017/0291062 | A1* | 10/2017 | Chang | A63B 69/04 |
| 2019/0054345 | A1* | 2/2019 | Hsu | A63B 22/0605 |
| 2020/0086169 | A1* | 3/2020 | Chuang | A63B 23/0205 |

* cited by examiner

ANGLE ADJUSTING MECHANISM AND FITNESS BIKE INSTALLED WITH THE ANGLE ADJUSTING MECHANISM

CROSS-REFERENCE TO RELATED APPLICATION

This application claims the priority benefit of China application serial no. 202021054705.9, filed on Jun. 10, 2020. The entirety of the above-mentioned patent application is hereby incorporated by reference herein and made a part of this specification.

BACKGROUND

Technical Field

The disclosure relates to an angle adjusting mechanism and a fitness bike installed with the angle adjusting mechanism, in particular to an angle adjusting mechanism which has a simple structure and is easy to adjust as well as stably positioned with decorative aesthetic value, and a fitness bike installed with the angle adjusting mechanism.

Description of Related Art

A fitness bike is a facility with a damping system for in-situ cycling practice, which gives the bike a durable and stable cycling resistance through the damping system. Such facility simulates actual riding conditions, and allows training to be carried out without being restricted to weather and location, so that the trainee can enjoy the fun of cycling at any time. Therefore, the fitness bike is popular. The structure of the fitness bike in related art is as shown in FIG. 1 and FIG. 2, including a first frame C and a second frame D that are hinged to each other. A handle assembly E is provided at an upper end of the first frame, a cushion assembly F is provided at an upper end of the second frame, and a lower end of the second frame is provided with pedals and a transmission assembly G. An angle adjusting mechanism is provided at a position where the first frame and the second frame are hinged together to adjust the position between the handle assembly and the cushion assembly to meet the needs of users of different heights. A conventional angle adjusting mechanism is shown in FIG. 3 and FIG. 4. In FIG. 3, when in use, the whole first frame and second frame can only be folded after the hanging ring bolt A is removed out. When the fitness bike is to be used, the frames are unfolded first, and the hanging ring bolt is inserted into the hole for positioning. As shown in FIG. 4, the angle adjustment of the first frame and the second frame can only be achieved after an elastic bolt B is pulled out. When in use, the elastic bolt is first pulled out, the first frame and the second frame are adjusted to the suitable angle, and after it is confirmed that the elastic bolt has been inserted into the hole of an adjusting lever C, the fitness bike is ready for use. The above two structures are relatively complicated and have a lot of exposed parts, resulting in poor aesthetic value and inconvenient installation.

SUMMARY

Technical Problem

The purpose of the disclosure is to solve the above-mentioned problems of related art, providing an angle adjusting mechanism which has a simple structure and is easy to adjust as well as stably positioned with decorative aesthetic value, and a fitness bike installed with the angle adjusting mechanism.

In order to achieve the above purpose, the technical solution of the present invention is as follows.

An angle adjusting mechanism includes a first bracket and a second bracket hinged to each other, wherein the second bracket is provided with two arc-shaped position-limiting slots, and a set of position-limiting holes is arranged in each of the position-limiting slots. A diameter of the position-limiting holes is larger than a slot diameter of the position-limiting slots, and a bolt passes through the first bracket and the position-limiting slots of the second bracket and is movable laterally along the first bracket and the position-limiting slot of the second bracket. An end portion of the bolt is provided with an adjusting segment and a position-limiting segment. A diameter of the adjusting segment is smaller than a diameter of the position-limiting segment. The adjusting segment and the position-limiting slot are engaged to adjust an angle of the second bracket relative to the first bracket. The position-limiting segment and the position-limiting holes are engaged to fix the first bracket and the second bracket after adjustment of the angle.

Further, the first bracket is provided with a rectangular mounting slot, the second bracket passes through the mounting slot and is hinged with the first bracket with a hinge member. The second bracket is provided with a U-shaped support plate at a position corresponding to the mounting slot. Two sides of the U-shaped support plate are respectively attached to two inner side walls of the mounting slot. The two sides of the U-shaped support plate are respectively provided with the arc-shaped position-limiting slot. Each of the arc-shaped position-limiting slots is provided with the position-limiting holes. The bolt movably passes through the mounting slot and the U-shaped support plate, and is sleeved with a restoring spring at an outer end through a positioning member. An end portion of the bolt is formed into a first position-limiting segment, a first adjusting segment, a second position-limiting segment and a second adjusting segment in sequence to engage with the two arc-shaped position-limiting slots and the position-limiting holes. The restoring spring is sleeved on the second adjusting segment, and has one end abutting against the positioning member and another end abutting against an outer side wall of the mounting slot.

Further, on the second bracket and in the mounting slot of the first bracket, a left decorative cover and a right decorative cover which are engaged with each other are provided to lock the U-shaped support plate therein. The left decorative cover and the right decorative cover are co-rotatable with the second bracket about a hinge point. An upper and a lower end of the mounting slot of the first bracket are respectively provided with an upper decorative cover and a lower decorative cover to coordinate with the left decorative cover and the right decorative cover.

Further, another outer end of the bolt is provided with a grip portion for easy operation.

The angle adjusting mechanism is installed on a fitness bike. The fitness bike includes a first frame and a second frame hinged to each other. An upper end of the first frame is provided with a handle assembly, an upper end of the second frame is provided with a cushion assembly, and a lower end of the second frame is provided with pedals and a transmission assembly. The first frame is the first bracket, and the second frame is the second bracket. The angle adjusting mechanism is provided at a position where the first frame and the second frame are hinged together to adjust a position between the handle assembly and the cushion assembly.

Further, the first frame and the second frame are both single-tube structures.

The disclosure adopts the above structure. When in use, one segment of the bolt is pulled out, so that the adjusting segment on the bolt is located in the position-limiting slots on the second bracket. Under the circumstances, the first bracket and the second bracket can rotate relative to each other, and the bolt is released when the brackets are rotated to a desired position. As such, the position-limiting segment on the bracket is properly engaged in the position-limiting holes of the arc-shaped position-limiting slots for positioning purpose, thereby achieving the locking state. The structure of the disclosure is simple, easy to adjust, stably positioned and has few exposed parts so the aesthetic value can be achieved.

The angle adjusting mechanism of the disclosure not only can be applied to the fitness bike, but also can be applied to any products that require two hinged rods for adjusting and fixing angles.

DESCRIPTION OF THE EMBODIMENTS

In order to further explain the technical solution of the disclosure, the disclosure will be described in detail below through specific embodiments.

Figure 1:
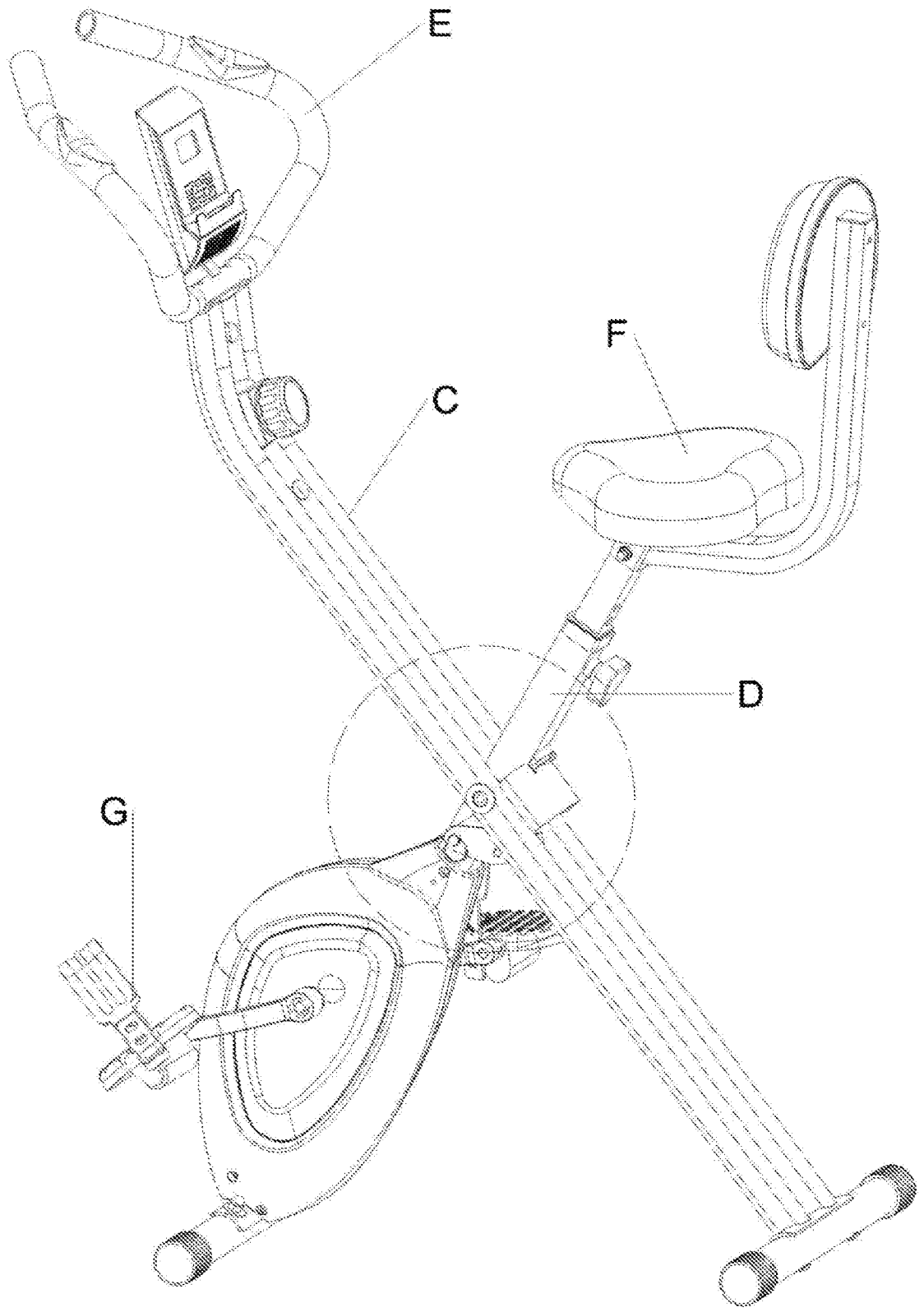
FIG. 1 is a schematic structural view of a first related art.
Figure 2:
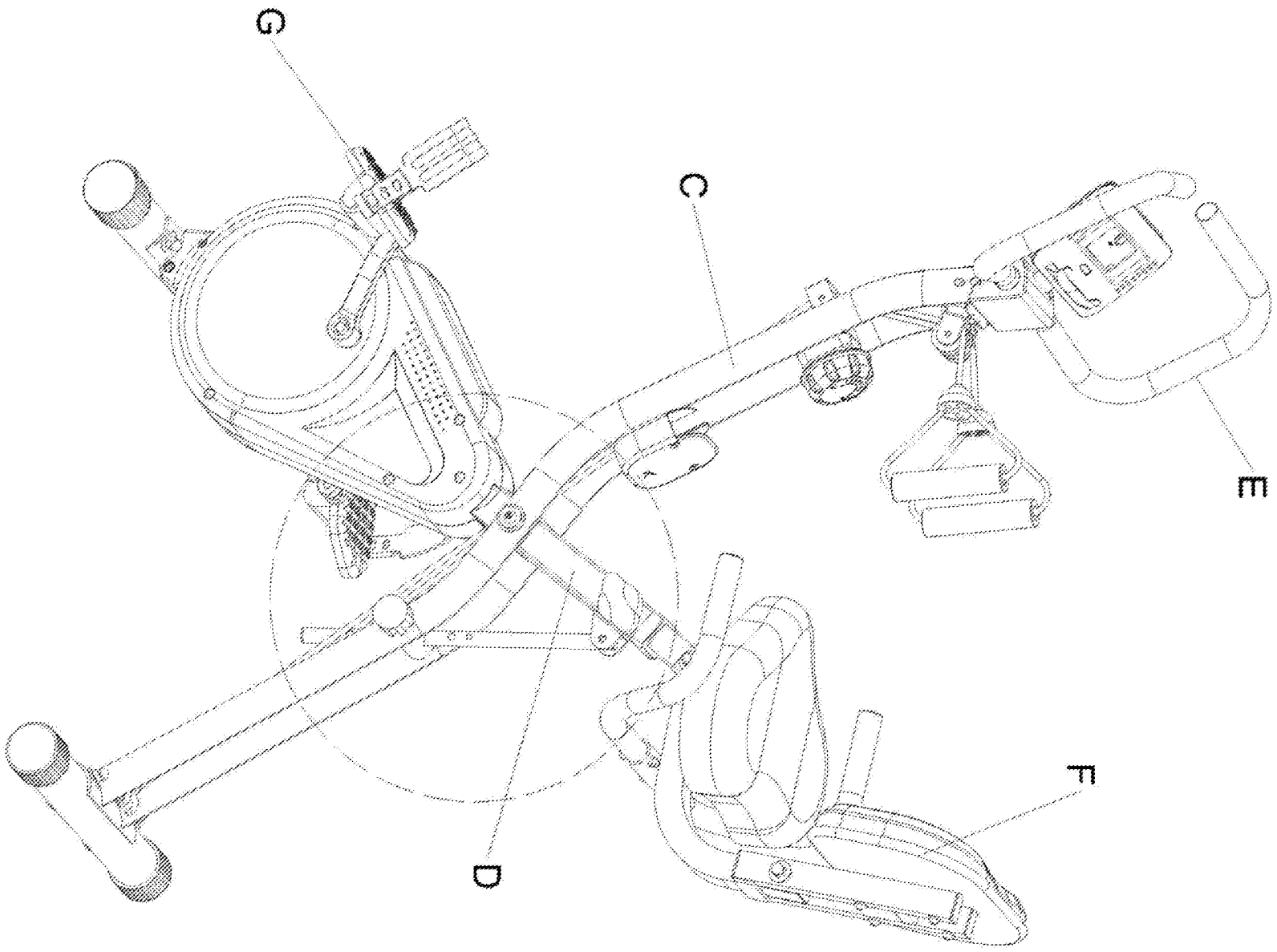
FIG. 2 is a schematic structural view of a second related art.
Figure 3:
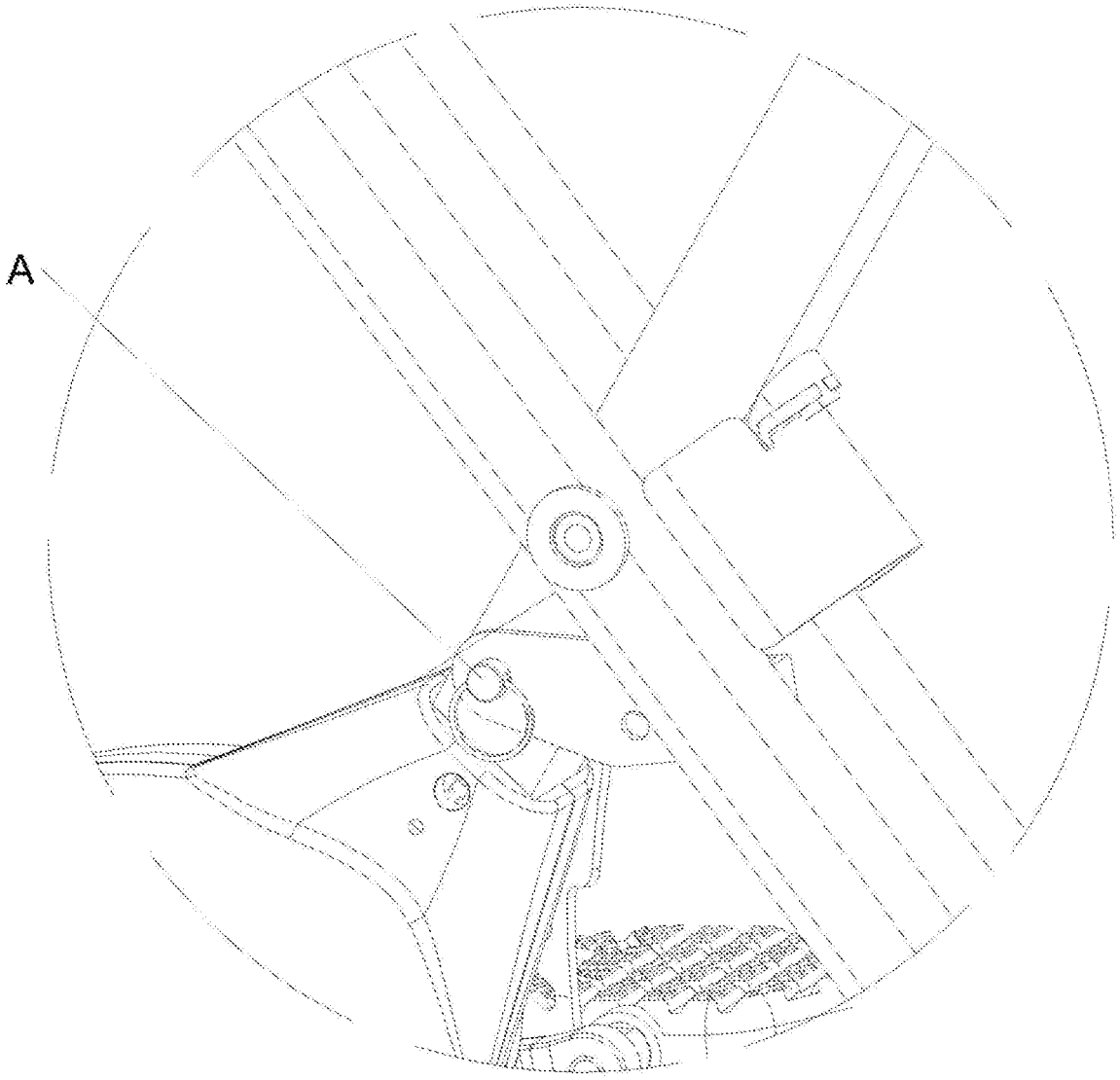
FIG. 3 is a schematic structural view of an angle adjusting mechanism in the first related art.
Figure 4:
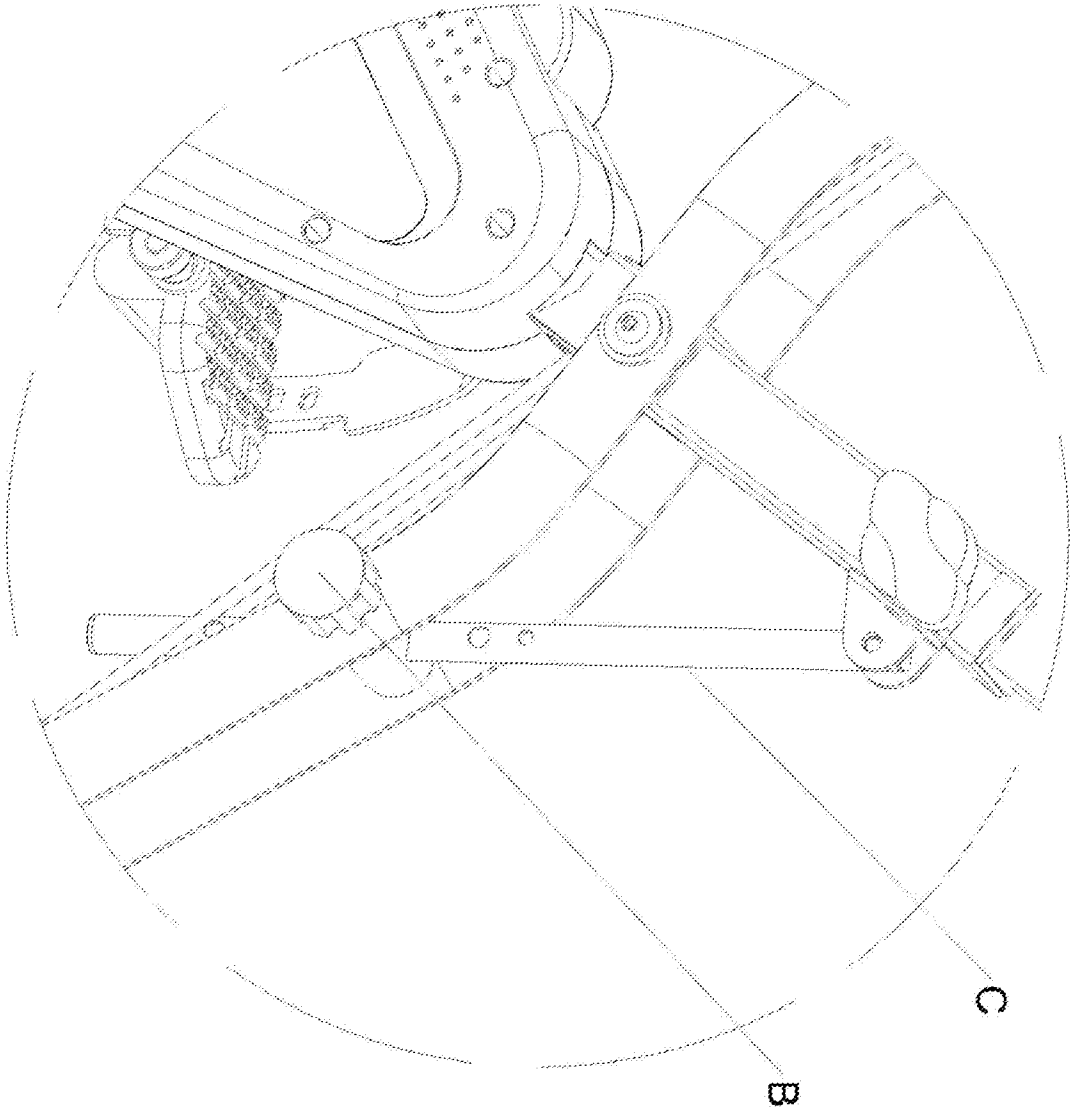
FIG. 4 is a schematic structural view of an angle adjusting mechanism in the second related art.
Figure 5:
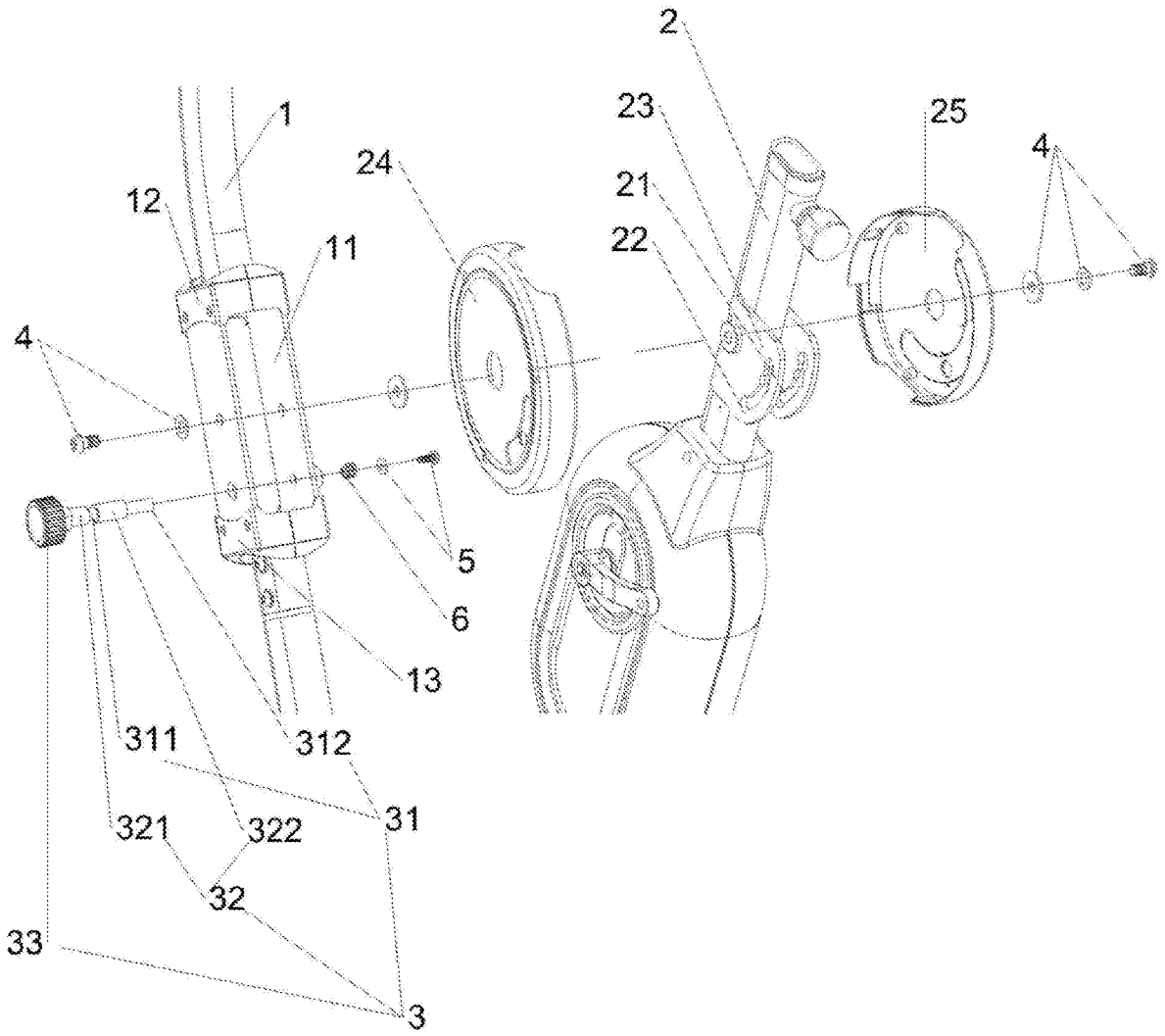
FIG. 5 is an exploded schematic view of an embodiment of the disclosure.
Figure 6:
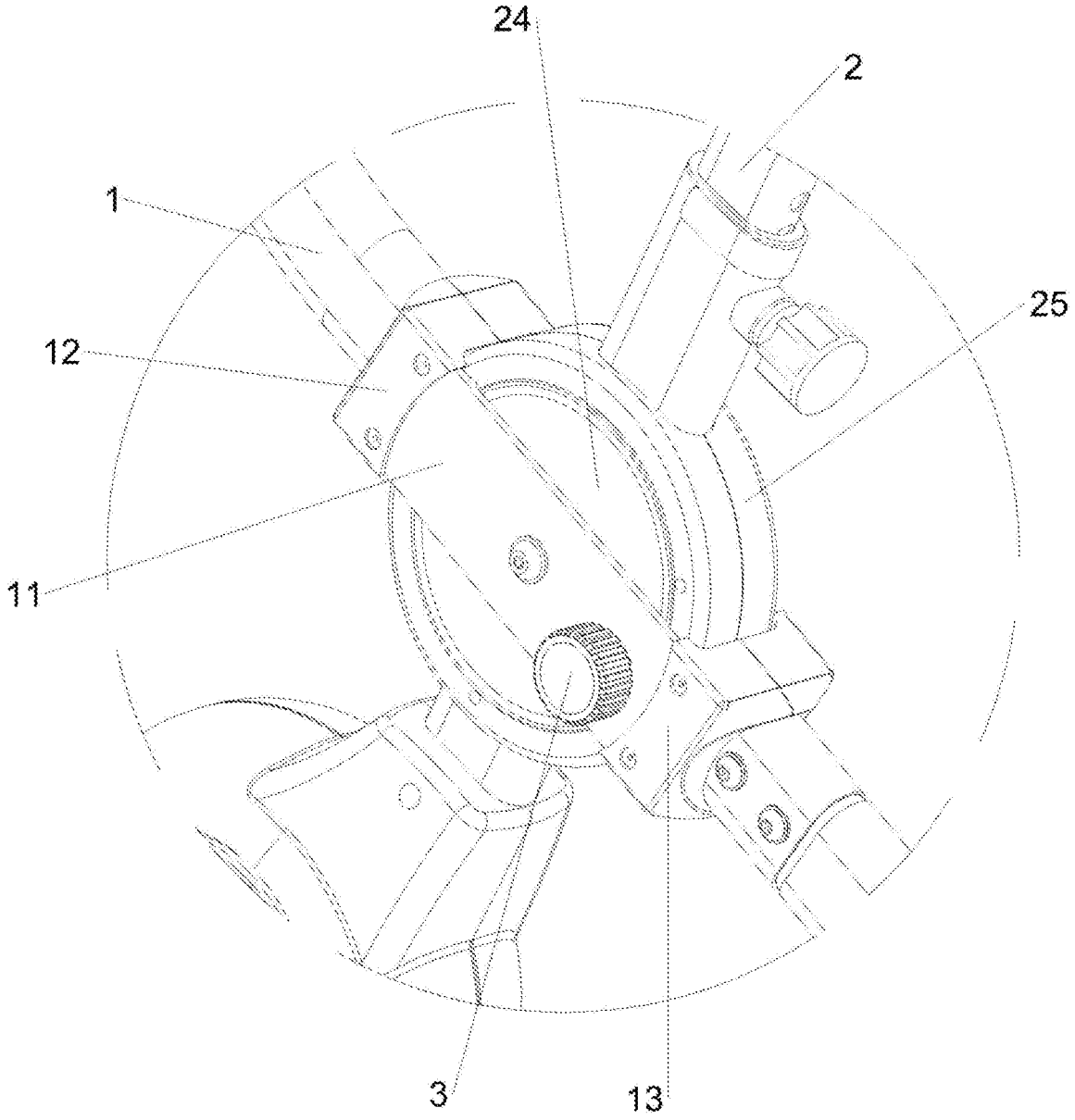
FIG. 6 is a schematic view of a combined structure of the embodiment of the disclosure.
Figure 7:
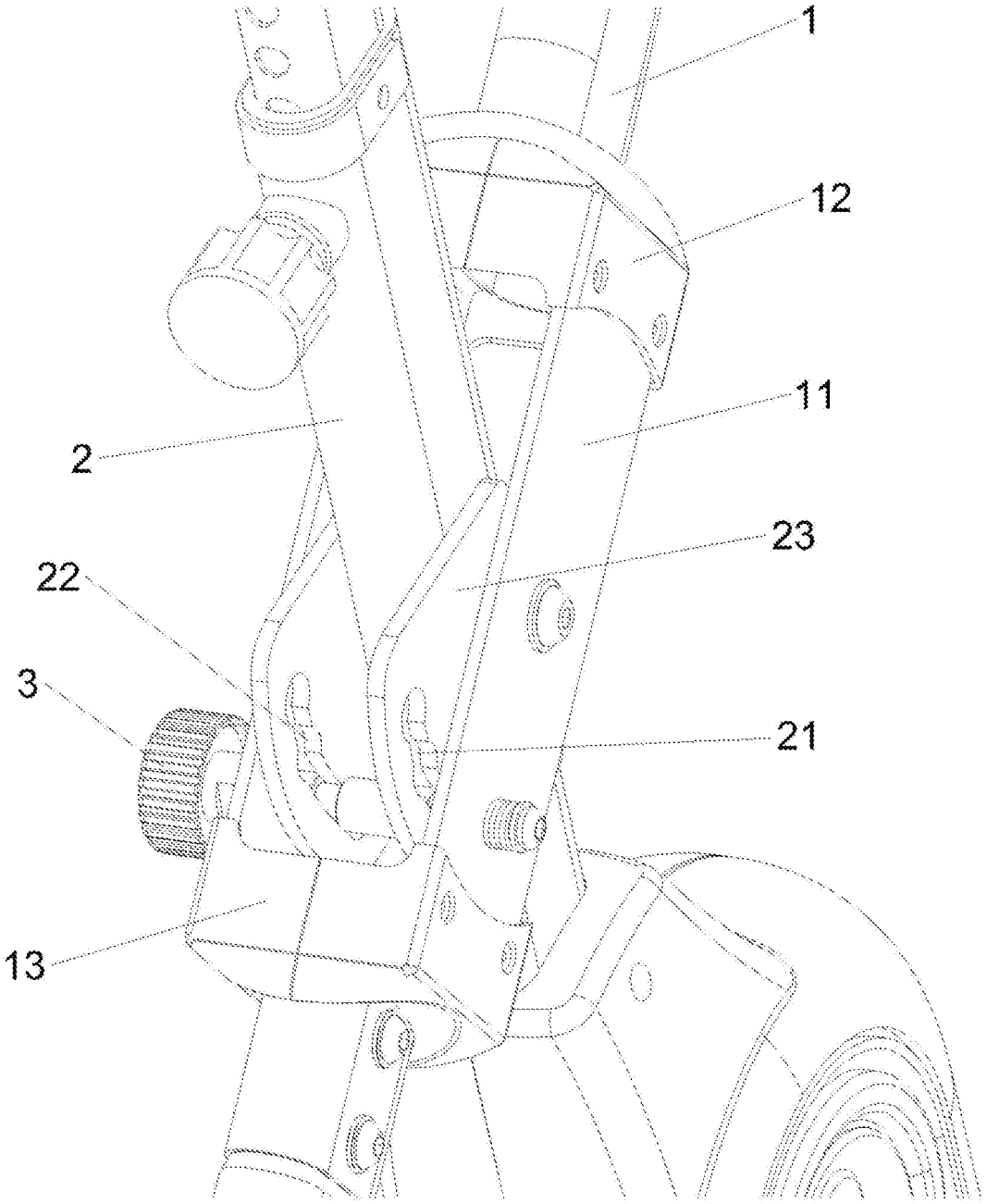
FIG. 7 is a first schematic view of an operating structure of the embodiment of the disclosure.
Figure 8:
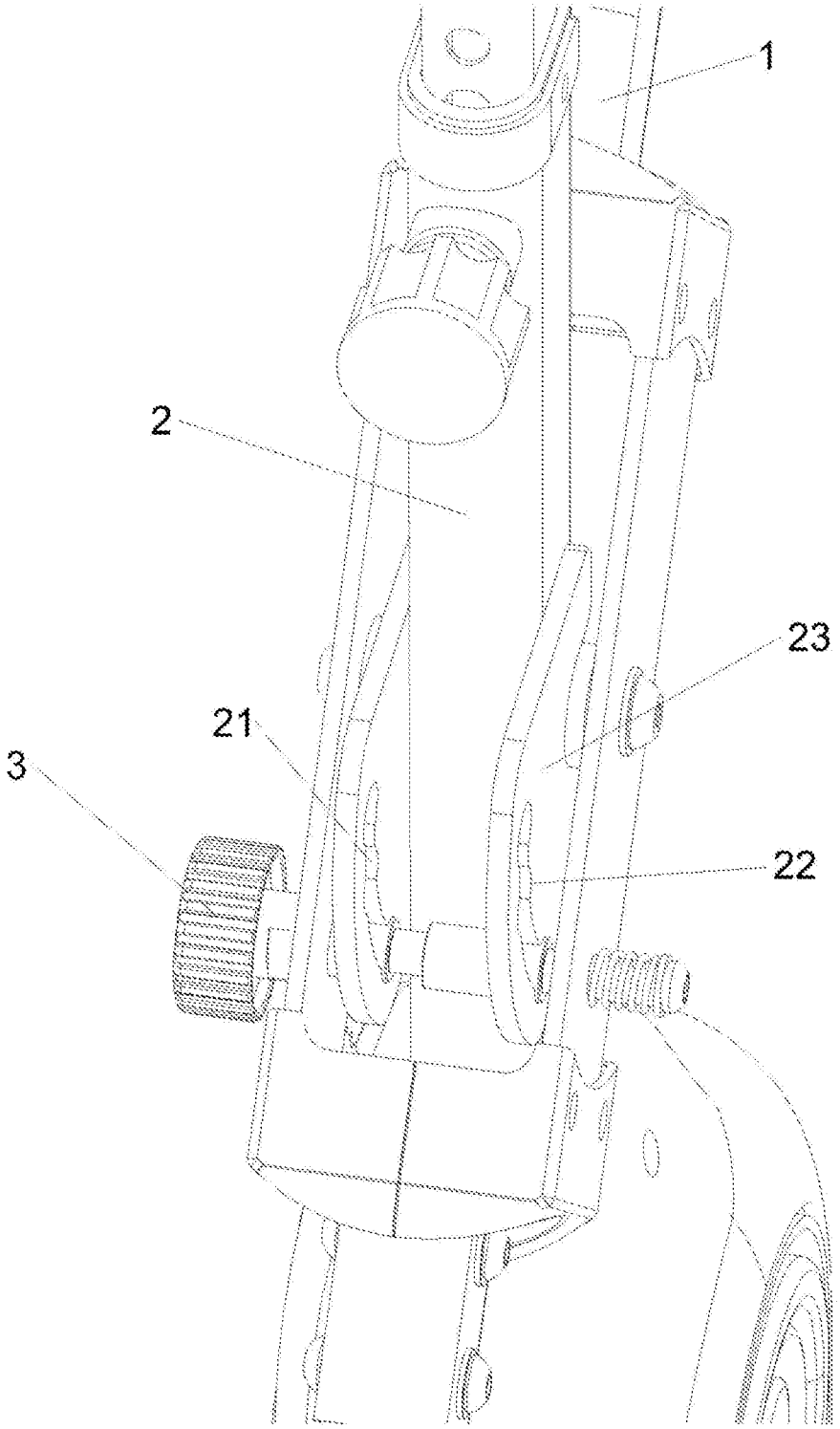
FIG. 8 is a second schematic view of the operating structure of the embodiment of the disclosure.
Figure 9:
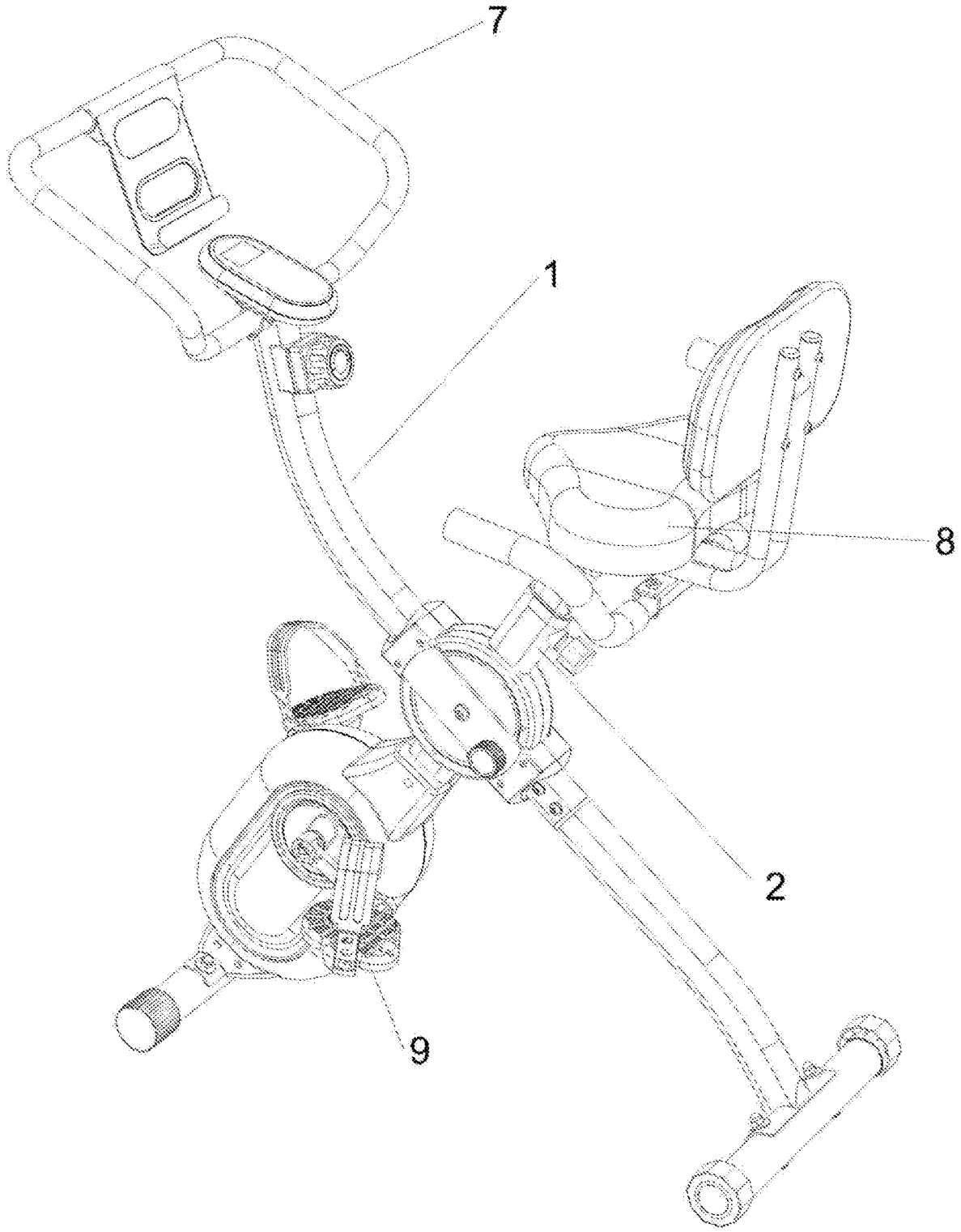
FIG. 9 is a schematic view of a fitness bike with an angle adjusting mechanism according to the embodiment of the disclosure.

As shown in FIG. 5 to FIG. 9, an angle adjusting mechanism includes a first bracket 1 and a second bracket 2 hinged to each other. The second bracket 2 is provided with two arc-shaped position-limiting slots 21, and a set of position-limiting holes 22 is arranged in each of the position-limiting slots 21. A diameter of the position-limiting holes 22 is larger than a slot diameter of the position-limiting slots 21. A bolt 3 passes through the first bracket 1 and the position-limiting slots 21 of the second bracket 2 and is movable laterally along the first bracket 1 and the position-limiting slots 21 of the second bracket 2. An end portion of the bolt 3 is provided with an adjusting segment 31 and a position-limiting segment 32. A diameter of the adjusting segment 31 is smaller than a diameter of the position-limiting segment 32. The adjusting segment 31 and the position-limiting slots 21 are engaged to adjust an angle of the second bracket 2 relative to the first bracket 1. The position-limiting segment 32 and the position-limiting holes 22 are engaged to fix the first bracket 1 and the second bracket 2 after adjustment of the angle.

In a specific embodiment, the first bracket 1 is provided with a rectangular mounting slot 11, the second bracket 2 passes through the mounting slot 11 and is hinged with the first bracket 1 through a hinge member 4 (in the embodiment the hinge member 4 consists of screws and gaskets coordinating with each other). The second bracket 2 is provided with a U-shaped support plate 23 at a position corresponding to the mounting slot 11. Two sides of the U-shaped support plate 23 are respectively attached to two inner side walls of the mounting slot 11. The two sides of the U-shaped support plate 23 are respectively provided with the arc-shaped position-limiting slots 21. Each of the arc-shaped position-limiting slots 21 is provided with the set of position-limiting holes 22. The bolt 3 movably passes through the mounting slot 11 and the U-shaped support plate 23, and is sleeved with a restoring spring 6 at an outer end through a positioning member 5 (which consists of screws and gaskets coordinating with each other in the embodiment). An end portion of the bolt 3 is formed into a first position-limiting segment 321, a first adjusting segment 311, a second position-limiting segment 322 and a second adjusting segment 312 in sequence to engage with the two arc-shaped position-limiting slots 21 and the position-limiting holes 22, another outer end of the bolt 3 is provided with a grip portion 33 for easy operation. The restoring spring 6 is sleeved on the second adjusting segment 312, and has one end abutting against the positioning member 5 and another end abutting against an outer side wall of the mounting slot 11.

On the second bracket 2 and in the mounting slot 11 of the first bracket 1, a left decorative cover 24 and a right decorative cover 25 which are engaged with each other are provided to lock the U-shaped support plate 23 therein. The left decorative cover 24 and the right decorative cover 25 are co-rotatable with the second bracket 2 about a hinge point. An upper end and a lower end of the mounting slot 11 of the first bracket 1 are respectively provided with an upper decorative cover 12 and a lower decorative cover 13 to coordinate with the left decorative cover 24 and the right decorative cover 25.

In the embodiment, the angle adjusting mechanism may be installed on a fitness bike. The fitness bike includes a first frame (i.e., first bracket 1) and a second frame (i.e., second bracket 2) hinged to each other. An upper end of the first frame 1 is provided with a handle assembly 7, an upper end of the second frame 2 is provided with a cushion assembly 8, and a lower end of the second frame 2 is provided with pedals and a transmission assembly 9. The angle adjusting mechanism is provided at a position where the first frame 1 and the second frame 2 are hinged together to adjust the position between the handle assembly 7 and the cushion assembly 8. The first frame 1 and the second frame 2 are both single-tube structures so the structure is simpler.

When in use, the first bracket is hinged to the second bracket through the hinge member. After the bolt passes through the first bracket and the holes on the second bracket, the restoring spring is sleeved on the other end of the bolt and fixed with the positioning member. When in use in a normal state, one segment of the bolt is pulled out, so that the adjusting segment on the bolt is located in the position-limiting slots on the second bracket. Under the circumstances, the first bracket and the second bracket can rotate relative to each other, and the bolt is released when the brackets are rotated to a desired position. As such, the position-limiting segment of the bolt is properly engaged in the position-limiting holes of the arc-shaped position-limiting slots for positioning purpose, thereby achieving the locking state. To release the locking state for another adjustment, it is only required to repeat the above operation. The structure of the disclosure is simple, easy to adjust, stably positioned and has few exposed parts so the aesthetic value can be achieved.

The angle adjusting mechanism of the disclosure not only can be applied to the fitness bike, but also can be applied to any products that require two hinged rods for adjusting and fixing angles.

The above description shows and describes the preferred embodiments of the disclosure. As mentioned above, it should be understood that the disclosure is not limited to the form disclosed herein, and should not be construed as an exclusion of other embodiments while can be used for various combinations, modifications, and environments. Meanwhile, within the scope of the idea of the disclosure described herein, modification can be made through the above teaching or technologies or knowledge in the related art. Also, variation and modification made by those skilled in the art without departing from the scope of the disclosure should fall within the scope of the appended claims of the disclosure.

What is claimed is:

1. An angle adjusting mechanism for a fitness bike, comprising a first bracket and a second bracket hinged to each other, wherein the second bracket is provided with two arc-shaped position-limiting slots, and a set of position-limiting holes is arranged in each of the position-limiting slots, a diameter of the position-limiting holes is larger than a slot diameter of each of the position-limiting slots, a bolt passes through the first bracket and the position-limiting slots of the second bracket and is movable laterally along the first bracket and the position-limiting slots of the second bracket, an end portion of the bolt is provided with an adjusting segment and a position-limiting segment, a diameter of the adjusting segment is smaller than a diameter of the position-limiting segment, the adjusting segment and the position-limiting slots are engaged to adjust an angle of the second bracket relative to the first bracket, the position-limiting segment and the position-limiting holes are engaged to fix the first bracket and the second bracket after adjustment of the angles.

2. The angle adjusting mechanism for the fitness bike according to claim 1, wherein the first bracket is provided with a rectangular mounting slot, the second bracket passes through the mounting slot and is hinged with the first bracket through a hinge member, the second bracket is provided with a U-shaped support plate at a position corresponding to the mounting slot, two sides of the U-shaped support plate are respectively attached to two inner side walls of the mounting slot, and are respectively provided with the arc-shaped position-limiting slots, each of the arc-shaped position-limiting slots is provided with the set of position-limiting holes, the bolt movably passes through the mounting slot and the U-shaped support plate, and is sleeved with a restoring spring at an outer end through a positioning member, the end portion of the bolt is formed into a first position-limiting segment, a first adjusting segment, a second position-limiting segment and a second adjusting segment in sequence to engage with the two arc-shaped position-limiting slots and the position-limiting holes, the restoring spring is sleeved on the second adjusting segment, and has one end abutting against the positioning member and another end abutting against an outer side wall of the mounting slot.

3. The angle adjusting mechanism for the fitness bike according to claim 2, wherein a left decorative cover and a right decorative cover are disposed on the second bracket and in the mounting slot of the first bracket, and are engaged with each other to lock the U-shaped support plate therein, the left decorative cover and the right decorative cover are co-rotatable with the second bracket about a hinge point, an upper end and a lower end of the mounting slot of the first bracket are respectively provided with an upper decorative cover and a lower decorative cover to coordinate with the left decorative cover and the right decorative cover.

4. The angle adjusting mechanism for the fitness bike according to claim 3, wherein another outer end of the bolt is provided with a grip portion for easy operation.

5. The fitness bike, installed with the angle adjusting mechanism as claimed in claim 4, the fitness bike comprises a first frame and a second frame hinged to each other, an upper end of the first frame is provided with a handle assembly, an upper end of the second frame is provided with a cushion assembly, and a lower end of the second frame is provided with pedals and a transmission assembly; wherein the first frame is the first bracket, and the second frame is the second bracket, the angle adjusting mechanism is provided at a position where the first frame and the second frame are hinged together to adjust a position between the handle assembly and the cushion assembly.

6. The fitness bike according to claim 5, wherein the first frame and the second frame are both single-tube structures.

7. The fitness bike, installed with the angle adjusting mechanism as claimed in claim 3, the fitness bike comprises a first frame and a second frame hinged to each other, an upper end of the first frame is provided with a handle assembly, an upper end of the second frame is provided with a cushion assembly, and a lower end of the second frame is provided with pedals and a transmission assembly; wherein the first frame is the first bracket, and the second frame is the second bracket, the angle adjusting mechanism is provided at a position where the first frame and the second frame are hinged together to adjust a position between the handle assembly and the cushion assembly.

8. The fitness bike according to claim 7, wherein the first frame and the second frame are both single-tube structures.

9. The fitness bike, installed with the angle adjusting mechanism as claimed in claim 2, the fitness bike comprises a first frame and a second frame hinged to each other, an upper end of the first frame is provided with a handle assembly, an upper end of the second frame is provided with a cushion assembly, and a lower end of the second frame is provided with pedals and a transmission assembly; wherein the first frame is the first bracket, and the second frame is the second bracket, the angle adjusting mechanism is provided at a position where the first frame and the second frame are hinged together to adjust a position between the handle assembly and the cushion assembly.

10. The fitness bike according to claim 9, wherein the first frame and the second frame are both single-tube structures.

11. The fitness bike, installed with the angle adjusting mechanism as claimed in claim 1, the fitness bike comprises a first frame and a second frame hinged to each other, an upper end of the first frame is provided with a handle assembly, an upper end of the second frame is provided with a cushion assembly, and a lower end of the second frame is provided with pedals and a transmission assembly; wherein the first frame is the first bracket, and the second frame is the second bracket, the angle adjusting mechanism is provided at a position where the first frame and the second frame are hinged together to adjust a position between the handle assembly and the cushion assembly.

12. The fitness bike according to claim 11, wherein the first frame and the second frame are both single-tube structures.

* * * * *